United States Patent [19]

Rosendahl

[11] 4,365,417

[45] Dec. 28, 1982

[54] TIN OPENER

[76] Inventor: Evert Rosendahl, Adolf Fredriksgatan 15A, S-217 74 Malmo, Sweden

[21] Appl. No.: 199,723

[22] PCT Filed: Dec. 1, 1978

[86] PCT No.: PCT/SE78/00088

§ 371 Date: Aug. 1, 1980

§ 102(e) Date: Jul. 31, 1980

[87] PCT Pub. No.: WO80/01159

PCT Pub. Date: Jun. 12, 1980

[51] Int. Cl.[3] ..... B67B 7/34

[52] U.S. Cl. ..... 30/422

[58] Field of Search ..... 30/420, 421, 422, 427

[56] References Cited

U.S. PATENT DOCUMENTS

| | | | |
|---|---|---|---|
| 2,462,416 | 2/1949 | Nelson | 30/427 |
| 2,522,382 | 9/1950 | Lampl | 30/422 |
| 2,592,936 | 4/1952 | McLean | 30/422 |
| 2,843,931 | 7/1958 | Lindahl | 30/422 |

FOREIGN PATENT DOCUMENTS

| | | | |
|---|---|---|---|
| 2116356 | 12/1971 | Fed. Rep. of Germany | 30/427 |

*Primary Examiner*—James L. Jones, Jr.

*Attorney, Agent, or Firm*—Lewis H. Eslinger

[57] ABSTRACT

A tin opener intended for opening a tin by wholly or partially cutting away a part of the tin from the remainder. The actual cutting operation is effected by a cutter roll which can be rotated about an axis of rotation and which during the cutting operation is rotated by a drive shaft via a driving gear-wheel and a gear-wheel. During the cutting process the tin is supported by a feed roll which is in driving engagement with the tin and secured to the drive shaft. In order to enable a tin which is to be opened to be introduced between the cutter roll and the feed roll, or to enable a tin which has been opened to be removed therefrom, the cutter roll is mounted in such a way as to be capable of being rotated about a second axis away from the axis of the drive shaft and the feed roll. The mounting is such that the axis of rotation is inclined in relation to the other axis and extends at a distance from the latter.

2 Claims, 8 Drawing Figures

TIN OPENER

RANGE OF APPLICATIONS

Many foodstuffs and other products are packaged in tins. Tins are opened with the aid of tin openers of various types. The present invention relates to a tin opener intended for opening a tin by cutting away from the remainder a part of the tin, wholly or partially. It is intended mainly for tins with two flat surfaces and a body shell connected with the aid of beads whereby at least on of the flat surfaces is cut away from the body shell in the vicinity of a bead, wholly or partially.

STATE OF THE ART

A tin opener for opening tins with two flat surfaces and a body shell connected with the aid of beads generally comprises a feed roll designed for driving engagement with the tin and for supporting the tin at the bead. A flat surface of a tin is frequently cut by means of a cutter roll, which in a working position near the feed roll is in cutting engagement with the flat surface. For the introduction of a tin which is to be opened between the cutter roll and the feed roll, or for the removal of a tin which has been opened, the outer roll can be shifted in some manner to a position of rest further removed from the feed roll and the cutting position.

One know method of arranging for the displacement of the cutter roll consists of mounting the cutter roll in a device capable of parallel displacement in a radial direction relative to the feed roll.

Another know method of arranging for the displacement of the cutter roll consists in mounting the cutter roll eccentrically on a device which can be rotated about its centre. An example of such a tin opener is described in U.S. Pat. No. 2,592,936.

EXPOSITION OF INVENTION

With a tin opener in accordance with the invention cutting as such is effected by a cutter roll capable of rotating about a rotary axis, which, during the cutting process, is rotated by a driving shaft via a driving gear-wheel and a gear-wheel. During the cutting process the tin is supported by a feed roll which is in driving engagement with the tin and mounted on the drive shaft. In order to enable the introduction of a tin which is to be opened between the cutter roll and the feed roll, or for the removal of a tin which has been opened from between the cutter roll and the feed roll, the cutter roll is mounted in such a way as to be capable of being rotated about a second axis separate from the axis of the drive shaft and from the feed roll. The mounting is such that the axis of rotation is inclined in relation to the other axis and is located at a distance from the latter. The cutter roll is preferably mounted on a spindle eccentrically secured within a tooth segment device capable of being rotated about the second axis.

DESCRIPTION OF FIGURES

FIG. 2 shows the opening mechanism of the tin opener and a section through its mounting in the body of the tin opener as seen from the front.

BEST EMBODIMENTS

Figure 1:
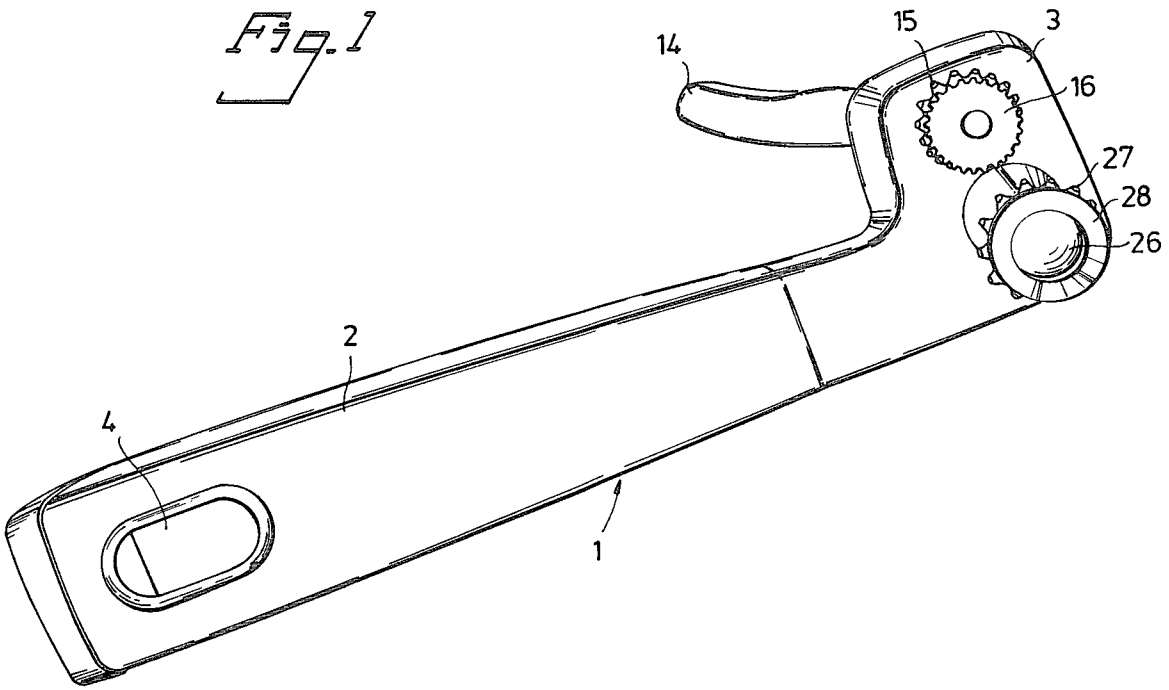
FIG. 1 gives a view of the tin opener.

The tin opener 1 shown in FIG. 1 consists of a body made of a plastic and an opening mechanism. The body is designed with a handle section 2 and a predominantly disc-shaped main section 3 angled in relation to the handle section. The handle section, which is partly hollow, contains a hole 4 for hanging the tin opener on a hook or similar device. The actual opening mechanism is supported by the main section which, as can be seen in FIG. 2, is hollow and has an inner space 5 limited by walls 6 and a cover 7. The cover is secured to the remainder of the main section by ultrasonic welding.

The opening mechanism comprises a drive shaft 8 with an axis 9 and a pinion 10. The drive shaft is threaded at one end and made flat at the other. As can be seen in FIG. 2, the drive shaft is mounted in cover 7 of the body head and one wall 6 by means of hubs 11 and 12 so that the pinion 10 is within space 5 and so that the drive shaft 8 can be rotated about its axis 9. That part of the drive shaft which projects from the cover comprises a substantially disc-shaped plastic knob 14 attached to the flat end of the shaft. To that end of the drive shaft which projects from wall 6 is secured a driving gear-wheel 15 and beyond that a feed roll 16 which is screwed to the threaded end of drive shaft 8.

The opening mechanism also comprises a tooth segment device. The tooth segment device is mounted in wall 6 and cover 7 so as to be capable of rotation about a second axis 20 which is parallel to the axis 9. The tooth segment device is supported in the wall by a hub 17 and in the cover by a round recess 18 into which fits a circular ridge 19 forming part of the cover. The tooth segment device has within space 5 a row of teeth 21 extending along an arc for approximately a quarter revolution about the second axis and is so arranged as to be capable of engagement with pinion 10. The row of teeth ends at one end with the tooth 31 which is considerably wider than the other teeth in the row of teeth and of the pinion. At the other end the row of teeth terminates in a concave surface 22 forming a circular arc and so arranged as to allow the pinion 10 to rotate freely when the latter is centrally opposite the concave surface. In recess 18 of the tooth segment device there is a projection 23 which extends outward towards the cover and is arranged to co-operate with a rubber cylinder 24 situated within the circular ridge 19 and an adjacent ridge 13 and is intended to import a rotary moment to the tooth segment device. When the concave surface 22 is centrally opposite pinion 10, the rotary moment tends to turn the tooth segment device in such a way as to cause the teeth in the row of teeth to engage the 10 teeth of the pinion.

From the free end surface of hump 17 there extends a spindle 25 which is embedded in the tooth segment device by casting and eccentrically located in relation to the second axis. On the thicker section of the spindle there is a gear-wheel 27 which can be rotated by means of a rivet 26, as well as a cutter roll connected with the gear-wheel. The spindle 25 is so orientated that the axis of rotation 29 of the gear-wheel and the cutter roll does not intersect the second axis but is parallel to the line intersecting the second axis at an angle of about 20°. The rivet is of an as such known yielding type (Starlock C6664) and is secured by the chamfered rim 32 at the end of the thinner spindle section. As a result, the cutter roll can move, to a limited extent, along the spindle, in the direction of the axis of rotation. The distance between the centre of the cutter roll and the second axis amounts to about 4.5 mm.

While cutting of a tin is actually in progress, the driving gear wheel 15, the feed roll 16, the gear-wheel 27 and the cutter roll 28 function, each and every one, individually and jointly, in an as such known manner. Hence each and every one of them may be designed in an as such known manner. When the opening mechanism is in the working position, the surfaces of the driving gear-wheel, the feed roll, the gear-wheel and the cutter roll which play a part in the cutting process may be positioned and orientated in as such known ways. During the cutting process, the cutter roll is accordingly in cutting engagement with that part of the tin which is to be cut whereas the feed roll supports the tin and is in driving engagement with it. Any further description of the actual driving gear-wheel, feed roll, gear-wheel and cutter roll as such or of the way in which the tin must be placed for opening should therefore not be necessary. Since the position of the tin which is being opened is as such in no way new, the tin has been omitted from the drawings so that other details can be presented more clearly. On the other hand, what is assumed to be new is the mounting of the cutter roll and the gear-wheel 27 and, probably, the orientation of their axis of rotation in relation to the axis about which the tooth segment device can be rotated.

Figure 8:
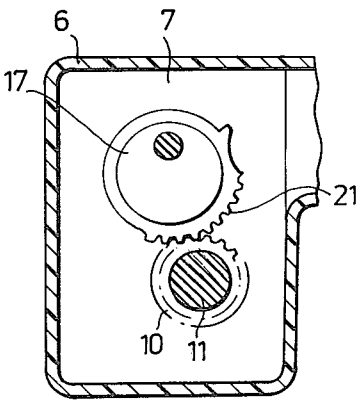
FIG. 8 shows how the tooth segment device with the spindle is orientated in relation to the drive shaft with the pinion when the opening mechanism is in the position of rest.

When the opening mechanism is in the position of rest, the tooth segment device is orientated in relation to the pinion as shown in FIG. 8. Since the surface 30 of the tooth segment device abuts a surface in the cover which is not shown and/or since tooth 31 at the end of the row of teeth is considerably wider than the pinion tooth gap, the tooth segment device cannot be rotated further by means of pinion 10 in the counterclockwise direction, see FIG. 8. Viewed from the drive shaft axis 9, the spindle 25 is, in this position of rest, above or away from the second axis 20, which pertains to the tooth segment device, so that the gear-wheel 27 and the cutter roll 28 are raised or turned away from the driving gear-wheel 15 and the feed roll 16. The distance between them is so large that the rim of a conventional tin can be introduced in the usual manner between the feed roll and the cutter roll.

If the pinion is turned in an anti-clockwise direction when the opening mechanism is in the position of rest shown in FIG. 8, the pinion 10 turns, since it engages the row of teeth 21, the tooth segment device, in the clockwise direct. If the pinion is turned sufficiently far in an anti-clockwise direction for the concave surface 22 of the tooth segment device to arrive in the process of turning in the clockwise direction centrally opposite the pinion so that the components assume the position shown in FIG. 7, the clockwise rotation of the tooth segment device ceases but pinion 10 can be rotated further in a counterclockwise direction in respect of FIGS. 7 and 8, so as to cause the cutter roll, etc. of the opening mechanism to open the tin in an as such known manner.

During the rotation of the tooth segment device from the position of rest to the working position, the centre of the cutter roll is shifted towards the axis 9 along a curved track the shape of which depends inter alia on the distance between the second axis 20 and the axis of rotation 29 as well as the distance between the axis 9 and the second axis 20. When the spindle 25 is embedded by casting into the tooth segment device it is given such a position and such an orientation as to ensure that the curved track near the idle position follows a substantially radial direction in relation to the axis 9. It should be possible to achieve this since the axis 9 and the axis of rotation 29 are, in the working position, located in a common plane and converge towards one another in a direction axially away from the supporting end of the feed roll on the drive shaft whereas the other axis 20, which pertains to the tooth segment device, is a distance from and parallel to the said common plane. Experience has shown, however, that it is preferable, when opening tins in an as such known manner with the aid of a feed roll and a cutter roll etc., for the axis of rotation of the feed roll to deviate by a few degrees, for instance 2°, from a position in the same plane as the axis of the feed roll. As regards the said curve, such a deviation by for instance 2° is without significant importance. Accordingly, with the embodiment shown in FIGS. 1–8, both orientations are in principle possible.

Figure 7:
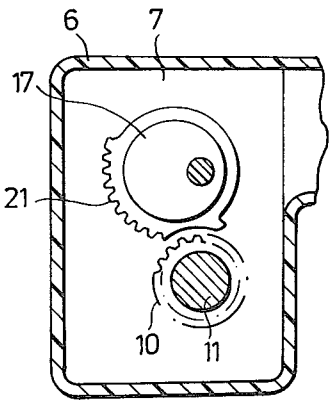
FIG. 7 illustrates how the tooth segment device with the spindle is orientated in relation to the drive shaft with the pinion when the opening mechanism is in the working position.
Figure 9:
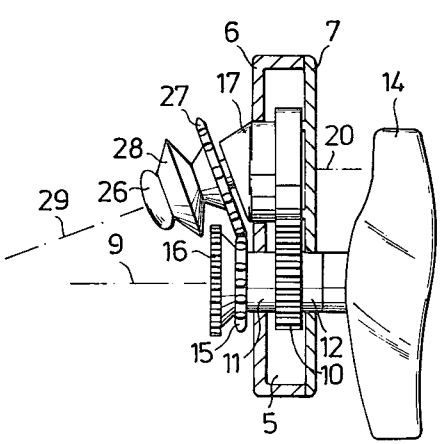
Figure 3:
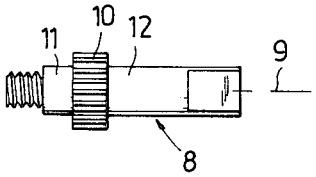
FIG. 3 shows a drive shaft with pinion in the opening mechanism.
Figure 4:
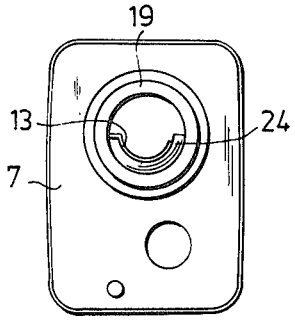
FIG. 4 shows a cover in the body of the tin opener as seen from the inside.
Figure 6:
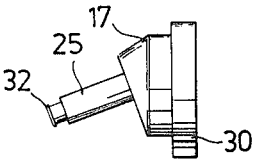
FIGS. 5 and 6, respectively, show a tooth segment device with spindle seen from the cover and in a direction as right angles to the drive shaft and the spindle, respectively.
Figure 5:
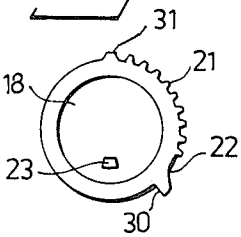

What has been said above about the curve along which the centre of the cutter roll moves when the tooth segment device is turned from the position of rest as shown in FIG. 8 to the working position as shown in FIG. 7 also applies to the curve along which the centre of the gear-wheel 27 moves in the course of this rotary motion. With the embodiment of a tin opener shown in FIGS. 1–8, spindle 25 is arranged eccentrically in such a way and the other components are so arranged that the centre of gear-wheel 27 moves almost entirely in a radial direction when is engaged by the driving gear-wheel and that the centre of the cutter roll moves, during the final phase of the said rotary motion, almost at right angles to the cover of the tin. This design has been shown to entail little danger of problems arising in connection with the engagement between the gear-wheel and the driving gear-wheel and little danger of the cutter roll coming into contact with the rim as in normally the case with tins.

As regards the said curve, the tin opener in accordance with FIGS. 1–8 therefore differs substantially from known tin openers such as described, for instance, in U.S. Pat. No. 2,592,936. For the tin opener in accordance with this American patent is so designed as to have, in the working position in accordance with FIGS. 2–4, 8 and 9, not only the axes of the spindle 31, 56 and the drive spindle 16, 45 but also the axis of rotation of the tooth segment device (spindle 21) sustantially in a common plane. This means that as the tooth segment device moves from the position of rest to the working position, the spindle 31, 56 with the cutter roll 32, 57 approaches, close to the working position, the working position between the spindle 16 and 21 or 45 and 51, respectively, subject, with the latter spindles, to a very large movement component at right angles to the common plane of the axes and to a very small movement component parallel to the said plane. As a result, the centre of the cutter roll moves, close to the working position, in a direction which in relation to the axis of the drive spindle is predominantly tangential.

Many variations of the embodiment shown in FIGS. 1–8 are possible within the framework of the invention. It is, for instance, not absolutely necessary for the axis 9 and the other axis to be exactly parallel. Nor is it necessary for the row of teeth 21 to extend along an arc amounting to precisely one quarter of a revolution, longer arcs corresponding for instance to about half a revolution being in principle feasible. The knob need not be shaped as shown but may, for instance, be designed as a crank. Instead of a projection and a spring-loaded arrangement, use may be made of other arrangements for providing a suitable rotary moment to the tooth segment device.

I claim:

1. A tin opener with a body (2, 3), a drive shaft (8) mounted in the body in such a way as to be capable of rotation about an axis (9), the said drive shaft having a feed roll (16) for driving engagement with the tin and further supporting a pinion (10), a tooth segment device so mounted in the body as to be capable of rotation about a second axis (20) between a position of rest and a working position, the said tooth segment device having a row of teeth (21) extending along an arc and arranged to engage the pinion (10) with a view to rotating the tooth segment device between the position of rest and the working position, a cutter roll (28) so mounted in a rotatable manner on a spindle embedded in the tooth segment device that the axis of rotation (29) of the cutter roll is inclined in relation to the second axis and the cutter roll is, in the working position, in cutting engagement with a tin abutting a feed roll but is in the position of rest at a distance from the tin, characterised in that the spindle (25) carries in as such known manner a gear-wheel (27) which in the working position engages a driving gear-wheel (15) on the drive shaft (8) but does not engage the driving gear-wheel in the position of rest, and in that the spindle (25) is eccentrically arranged on the tooth segment device in such a way while the axis or rotation (29) extends at such a distance from and with such an orientation relative to the second axis that as the tooth segment device turns, in the vicinity of the working position, respectively to or from the working position, the centre of the cutter roll (28) moves respectively towards or away from the axis (9) in a predominantly radial direction relative to the axis (9).

2. A tin opener according to claim 1 characterised in that the axis (9) and the second axis (20) are parallel and in that in the working position the axis (9) and the axis of rotation (29) are located in a common plane and converge towards one another in a direction axially outward from the end of the drive shaft which carries the cutter roll (16), whereas the other axis (20) is located at a distance from the common plane.

* * * * *